US007911405B2

(12) United States Patent
Pascolini et al.

(10) Patent No.: US 7,911,405 B2
(45) Date of Patent: Mar. 22, 2011

(54) MULTI-BAND LOW PROFILE ANTENNA WITH LOW BAND DIFFERENTIAL MODE

(75) Inventors: Mattia Pascolini, Plantation, FL (US); Carlo Dinallo, Plantation, FL (US); Paul Morningstar, North Lauderdale, FL (US)

(73) Assignee: Motorola, Inc., Schaumburg, IL (US)

( * ) Notice: Subject to any disclaimer, the term of this patent is extended or adjusted under 35 U.S.C. 154(b) by 403 days.

(21) Appl. No.: 12/185,986

(22) Filed: Aug. 5, 2008

(65) Prior Publication Data

US 2010/0033380 A1 Feb. 11, 2010

(51) Int. Cl.
*H01Q 9/16* (2006.01)
*H01Q 1/38* (2006.01)
*H01Q 11/12* (2006.01)

(52) U.S. Cl. ..... 343/806; 343/700 MS; 343/741

(58) Field of Classification Search ..... 343/700 MS, 343/711, 749, 806, 846, 895
See application file for complete search history.

(56) References Cited

U.S. PATENT DOCUMENTS

| | | | | |
|---|---|---|---|---|
| 6,417,816 | B2 * | 7/2002 | Sadler et al. | 343/795 |
| 7,307,591 | B2 * | 12/2007 | Zheng | 343/702 |
| 7,705,791 | B2 * | 4/2010 | Ollikainen | 343/702 |
| 2008/0042916 | A1 * | 2/2008 | Ma | 343/767 |

* cited by examiner

*Primary Examiner* — Shih-Chao Chen
(74) *Attorney, Agent, or Firm* — Mayback & Hoffman, P.A.; Gregory L. Mayback; Katie M. Blakley

(57) ABSTRACT

An antenna assembly includes a ground plane and an element coupled to the ground plane. The element has a center point, a first element portion extending away from the center point on a first side of the center point for a first distance in a first direction, bending at a first approximately 180 degree bend, extending towards the center point for a second distance in a second direction, bending at a second approximately 180 degree bend, and extending away from the center point for a third distance in the first direction. The element also has a second element portion provided on a second side of the center point opposite the first element portion on the first side of the center point, the second element portion being substantially a mirror image of the first element portion. The element also includes a ground leg located on the first side of the center point a first distance from the center point, extending substantially perpendicular to the first and second element portions, and coupling the element to the ground plane and a feed leg located on the second side of the center point a second distance from the center point, the feed leg extending substantially parallel to the ground leg.

20 Claims, 14 Drawing Sheets

-PRIOR ART-

-PRIOR ART-

-PRIOR ART- 1
2.0000e+002
3.0000e+002
800MHz 2
4.500e+002
3.750e+002
810MHz 3
820MHz 4
850MHz 5
880MHz
06 Apr 2007
XY PLOT 1
FD_over_2d front
17:18:32
dB(c(Lumped Setup1 : Sree

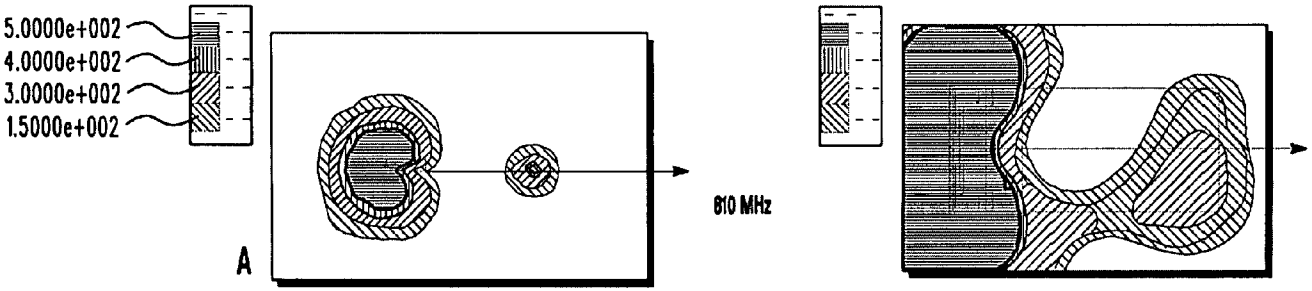
FIG. 23
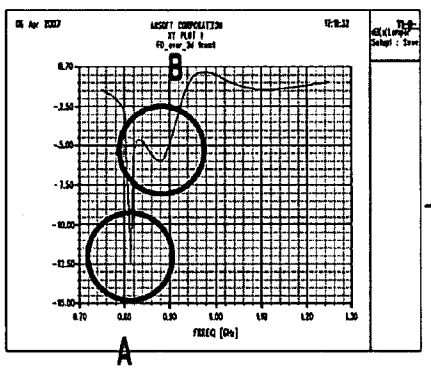
FIG. 22
FIG. 24
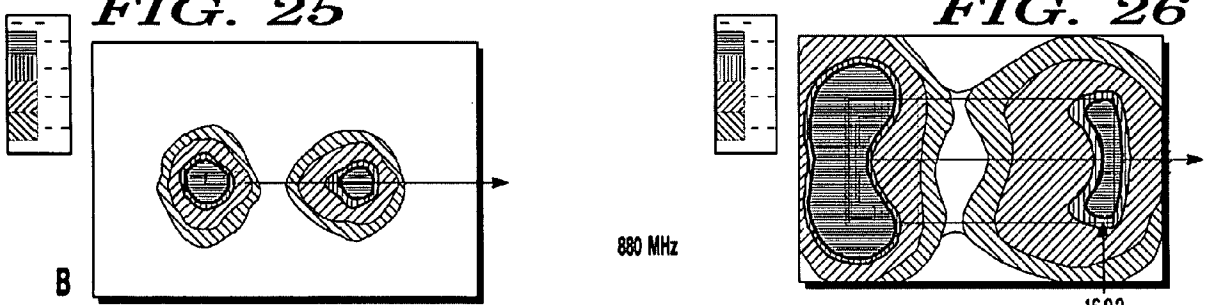
FIG. 25
FIG. 26

MULTI-BAND LOW PROFILE ANTENNA WITH LOW BAND DIFFERENTIAL MODE

FIELD OF THE INVENTION

This invention relates in general to wireless communication devices, and more particularly, to a multi-band antenna that addresses the need for Hearing Aid Compatibility compliance for mobile devices.

BACKGROUND OF THE INVENTION

Wireless communication is the transfer of information over a distance without the use of electrical conductors or wires. This transfer is actually the communication of electro-magnetic (EM) waves between a transmitting entity and remote receiving entity. The communication distance can be anywhere from a few inches to thousands of miles.

Wireless communication is made possible by antennas that radiate and receive the EM waves to and from the air, respectively. The function of the antenna is to "match" the impedance of the propagating medium, which is usually air or free space, to the source that supplies the signals sent or interprets the signals received.

Unfortunately, wireless handsets (cellular telephones) often generate interference with hearing aids, which leads to uncomfortable audible noise to the user or those around the user of the hearing aid. The Federal Communication Commission (FCC) will soon require that at least some of the wireless handsets offered by each wireless service provider meet certain standards aimed at reducing interference with hearing aids. These Hearing Aid Compatibility (HAC) standards stipulate that the electric and magnetic field strength within at least six squares of a nine square measurement grid centered on the speaker of a qualifying handset and spaced from the handset by 1 centimeter, be below predetermined limits. FIG. 1 depicts a "candy bar" form factor wireless handset 100 with the aforementioned nine square measurement grid 102.

It has been found that it is particularly difficult to make "candy bar" wireless handsets that meet the FCC HAC requirements. Most currently available "candy bar" wireless handsets use internal antennas that are located either at the bottom or top end of the handset's internal printed circuit board. Examples of internal antennas include the Planar Inverted "F" Antenna (PIFA) and the more advanced Folded Inverted Conformal Antenna (FICA). Generally, internal antennas of wireless handsets use the ground plane of the wireless handset's internal circuit board and/or other conductive parts of the handset as a counterpoise in at least some operating bands (e.g., operating bands in the 800 MHz to 900 MHz range). Consequently, high electric field regions occur both near the antenna and at the opposite end of the handset (at the remote end of the counterpoise.) Such high electric fields are problematic for meeting the FCC HAC requirements. A few methods for mitigating the electric fields have been proposed, but all of them require additional parts to be added and/or extra complexity.

Therefore, a need exists to overcome the problems with the prior art as discussed above.

SUMMARY OF THE INVENTION

An antenna assembly, in accordance with an embodiment of the present invention, includes a ground plane and an element coupled to the ground plane. The element has a center point, a first element portion extending away from the center point on a first side of the center point for a first distance in a first direction, bending at a first approximately 180 degree bend, extending towards the center point for a second distance in a second direction, bending at a second approximately 180 degree bend, and extending away from the center point for a third distance in the first direction. The element also has a second element portion provided on a second side of the center point opposite the first element portion on the first side of the center point, the second element portion being substantially a mirror image of the first element portion. The element also includes a ground leg located on the first side of the center point a first distance from the center point, extending substantially perpendicular to the first and second element portions, and coupling the element to the ground plane and a feed leg located on the second side of the center point a second distance from the center point, the feed leg extending substantially parallel to the ground leg.

In accordance with another feature of the present invention, parts of the first and second element portions lie within a first plane, a part of the first element portion lies within a second plane that is different from the first plane, and a part of the second element portion lies within a third plane that is different from the first and second planes.

In accordance with yet another feature of the present invention, the second and third planes are approximately perpendicular to the first plane.

In accordance with still another feature of the present invention, the second and third planes are approximately parallel with each other.

In accordance with an additional feature of the present invention, a part of the first element portion immediately adjacent the first approximately 180 degree bend and a part of the mirror-image second element portion immediately adjacent a corresponding approximately 180 degree bend of the second element portion are in the second plane.

In accordance with a further feature of the present invention, the antenna automatically operates in a differential mode at the first frequency range and automatically operates in a common mode at the second frequency range.

A wireless communication device, in accordance with an embodiment of the present invention, includes a signal source operable to output at least a first frequency range and a second frequency range, where all frequencies within the second frequency range are higher than frequencies within the first frequency range. The device also includes a ground plane and an antenna coupled to both the ground plane and the signal source, where the antenna has a center point and includes a first double folded element arm having a first portion extending away from the center point of the antenna on a first side of the center point in a first direction substantially parallel with the ground plane and a second portion extending towards the center point of the antenna in a second direction substantially parallel with the ground plane. The antenna also includes a second double folded element arm on a second side of the center point and substantially symmetrical to the first double folded element arm with respect to the center point, the antenna automatically operating in a differential mode at the first frequency range and automatically operating in a common mode at the second frequency range.

In accordance with another feature, the present invention includes a reactive load disposed between the second element arm and the ground plane, the reactive load causing the antenna to automatically operate in the common mode at a third frequency range that is higher than the second frequency range.

In accordance with a further feature of the present invention, the first and second folded element arms each extend away from the center point of the antenna for a first distance, fold at a first approximately 180 degree bend, extend toward the center point for a second distance, fold at a second approximately 180 degree bend, and extend away from the center point for a third distance.

In accordance with a yet another feature, first-plane portions of the first and second element arms lie within a first plane, a second-plane portion of the first element arm lies within a second plane that is different from the first plane, and a third-plane portion of the second element arm portion lies within a third plane that is different from the first and second planes.

BRIEF DESCRIPTION OF THE DRAWINGS

The accompanying figures, where like reference numerals refer to identical or functionally similar elements throughout the separate views, and which together with the detailed description below are incorporated in and form part of the specification, serve to further illustrate various embodiments and to explain various principles and advantages all in accordance with the present invention.

FIGS. 22 to 26 show exemplary E-Field snapshots of low-band resonances of the antenna of FIG. 11, according to an embodiment of the present invention.

DETAILED DESCRIPTION

Figure 1:
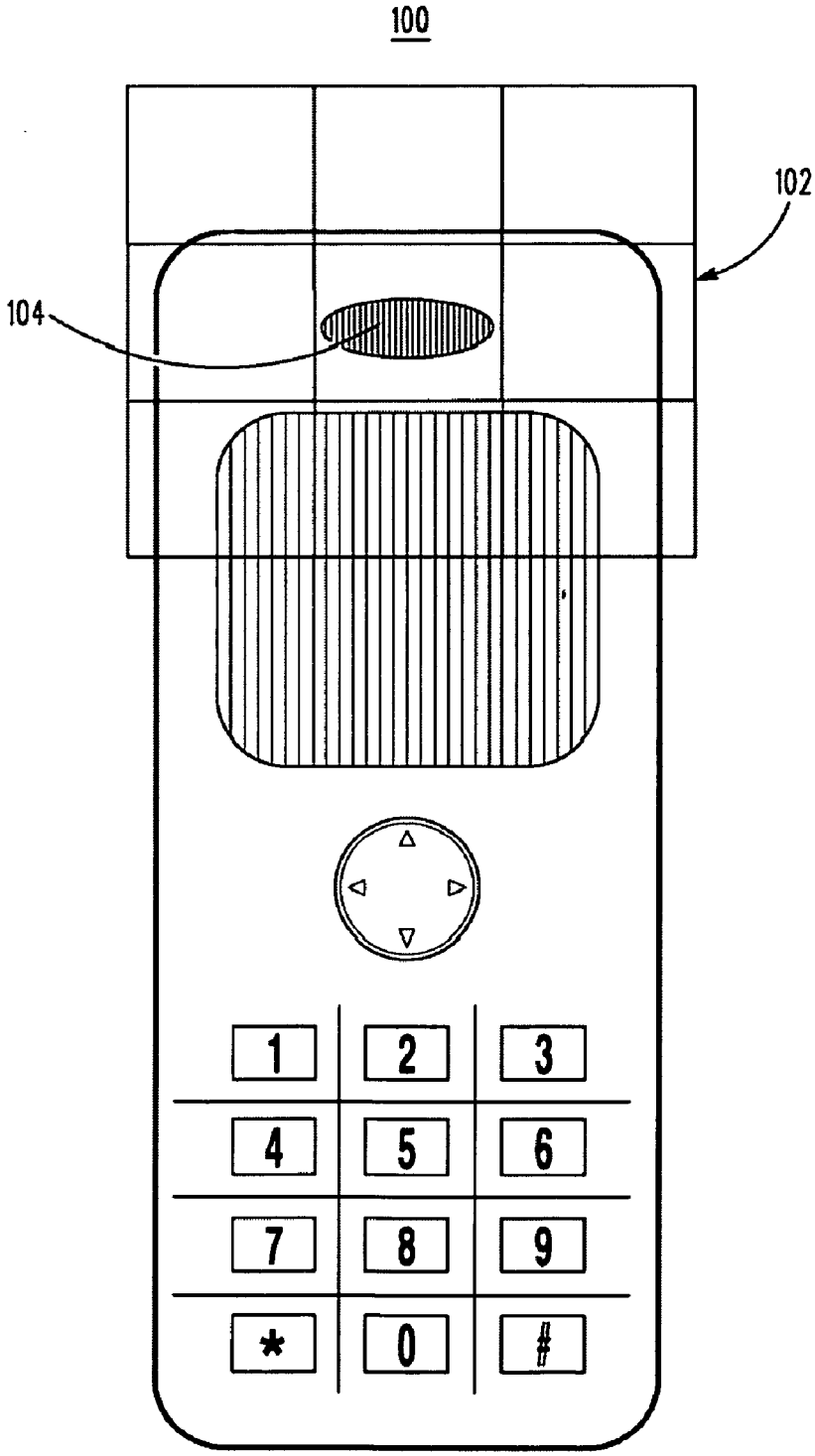
FIG. 1 depicts a prior-art "candy bar" form factor wireless handset overlaid with a nine square measurement grid used to define maximum allowable field strength for FCC HAC conformance.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

Embodiments herein can be implemented in a wide variety of ways using a variety of technologies that provide a novel and efficient multi-band antenna structure that, according to one embodiment, includes a meander multi-band planar inverted antenna with two substantially symmetric arms, a feed post, and a ground post. The antenna is capable of operating in multiple operating modes, including at least two differential modes (one for the low band and one for the high band) and two common modes. The structure, if properly tuned, exhibits a (non pure) differential mode in, for instance, the low GSM 850 band, therefore reducing the E-field values by 3 dB and achieving HAC compliance. In one embodiment, a reactive load is used on the ground post to selectively vary the resonant frequency of the common modes, while leaving the differential mode frequencies unchanged.

Antennas are well known in the art. Briefly, an antenna is a transducer designed to transmit and receive radio waves, which are a class of EM waves. Antennas accomplish this communication by converting radio-frequency electrical currents into EM waves, and vice versa and are used in systems such as radio and television broadcasting, point-to-point radio communication, wireless local area network (LAN), radar, space exploration, and many others.

Physically, an antenna is simply an electrical conductor that generates a radiating EM field in response to an applied alternating voltage and the associated alternating electric current. Alternatively, an antenna can be placed in an EM field so that the field will excite or induce an alternating current in the antenna and a voltage between its terminals. It is through these antennas that electronic wireless communication is made possible.

The EM "spectrum" is the range of all possible EM radiation. This spectrum is divided into frequency "bands," or ranges of frequencies, that are designated for specific types of communication. Many radio devices operate within a specified frequency range, which limits the frequencies on which the device is allowed to transmit.

EM energy at a particular frequency (f) has an associated wavelength (λ). The relationship between wavelength and frequency is expressed by:

$$\lambda = c/f,$$

where c is the speed of light (299,792,458 m/s). It therefore follows that high-frequency EM waves have a short wavelength and low-frequency waves have a longer wavelength.

The Global System for Mobile communications (GSM) is the most popular standard for mobile phones in the world. GSM frequency bands or frequency ranges are the radio spectrum frequencies designated by the International Telecommunication Union for the operation on the GSM system for mobile phones.

GSM-850 and GSM-1900 are used in the United States, Canada, and many other countries in the Americas. GSM-850 is also sometimes called GSM-800 because this frequency range was known as the "800 MHz Band" when it was first allocated for Advanced Mobile Phone System (AMPS) usage in the United States in 1983.

GSM-850 uses the frequency band 824-849 MHz to send information from the Mobile Station to the Base Transceiver Station (uplink) and the frequency band 869-894 MHz for the other direction (downlink). GSM-1900 uses the frequency band 1850-1910 MHz to send information from the Mobile Station to the Base Transceiver Station (uplink) and the frequency band 1930-1990 MHz for the other direction (downlink).

The 850 MHz band is often referred to as "cellular," as the original analog cellular mobile communication system was allocated in this spectrum. PCS, an acronym for "Personal Communications Service," represents the original name in North America for the 1900 MHz band. Providers commonly operate in one or both frequency ranges.

GSM-1800 uses the frequency band 1710-1785 MHz to send information from the Mobile Station to the Base Transceiver Station (uplink) and the frequency band 1805-1880 MHz for the other direction (downlink). GSM-1800 is referred to as "DCS" in Hong Kong and the United Kingdom.

FIG. 1 depicts a typical "candy bar" form factor wireless handset 100 overlaid with a nine square measurement grid 102 used to define maximum allowable field strength for FCC HAC conformance. The wireless handset 100 includes an earpiece speaker 104 and the nine square measurement grid 102 is centered 1 cm above the earpiece speaker 104. The position of the grid 102 corresponds roughly to the position of a hearing aid when the handset 100 is held to a hearing impaired user's ear. The FCC HAC requirements for the 850 MHz band stipulate that the electric field is not to exceed 48.5 dBV/meter and the magnetic field is not to exceed −1.9 dBA/meter in the measurement grid, with the exception that preceding limits may be exceed within any three grids squares forming a contiguous area, not including the center square of the grid. The contiguous areas for the electric and magnetic fields may be different but must have at least one square in common. Thus, for each of the electric and magnetic fields, there must be at least a contiguous area made up of six grid squares in which the field limit is met, so that a hearing-impaired user can find a position for holding the handset 100 to his or her ear in which audible interference is reduced. It is interesting to note that, in a "candy bar" form factor wireless handset, that uses the ground plane of the main printed circuit board as the antenna counterpoise, the strong electric fields near the upper end of the handset are more problematic from the stand point of HAC requirements compared to the magnetic field which tends to be stronger near the center of the handset.

Figure 2:
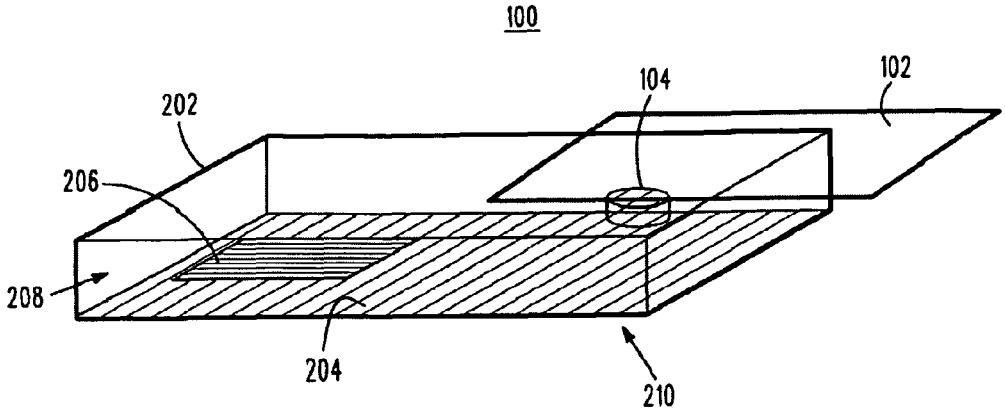
FIG. 2 is a perspective view of a prior-art RF simulation model of a "candy bar" wireless handset.

FIG. 2 is a perspective view of an RF simulation model of the "candy bar" wireless handset 100 used in embodiments of the invention. The RF model handset 100 includes a housing 202 enclosing a ground plane 204 (which in an actual handset would be part of a printed circuit board.) An internal FICA antenna 206, for example, is located at a bottom end 208 of the RF model hand set 100 on a back side 210 (facing away from the user) of the ground plane 204. The FCC HAC measurement grid 102 is also shows in position above the speaker 104.

Figure 3:
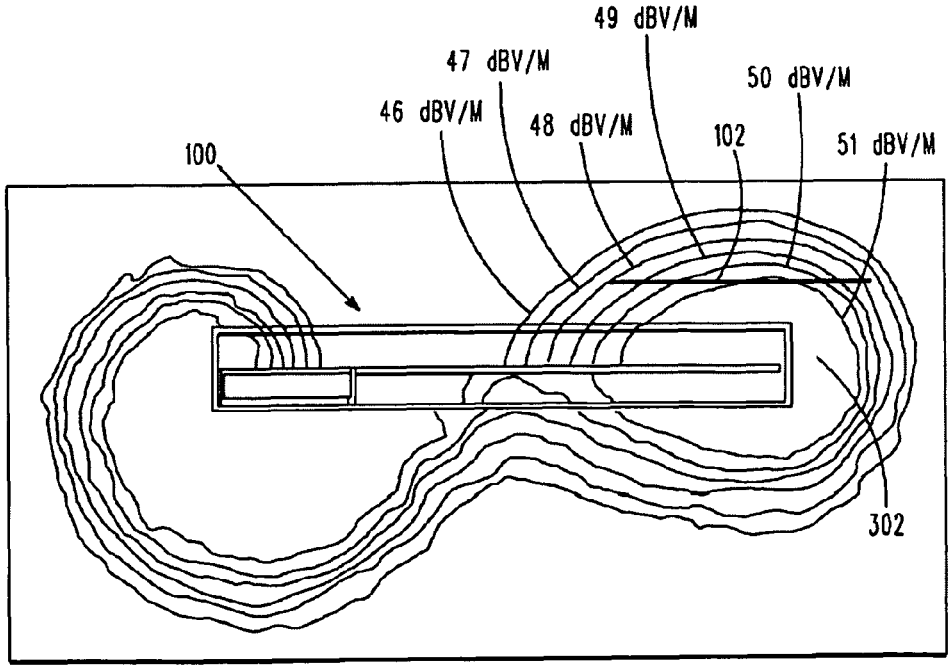
FIG. 3 is aside elevational view of the model shown in FIG. 2 with a superposed contour plot of electric field strength.

FIG. 3 is a side elevational view of the wireless handset 100 shown in FIG. 2 with a superposed contour plot of electric field strength. As shown in FIG. 3 a high field region 302 bounded by the contour on which the field strength is 51 dBV/m partially overlies the position of the FCC HAC measurement grid 102. In this case, the FCC HAC limits on the maximum strength of the electric field are exceeded.

Figure 4:
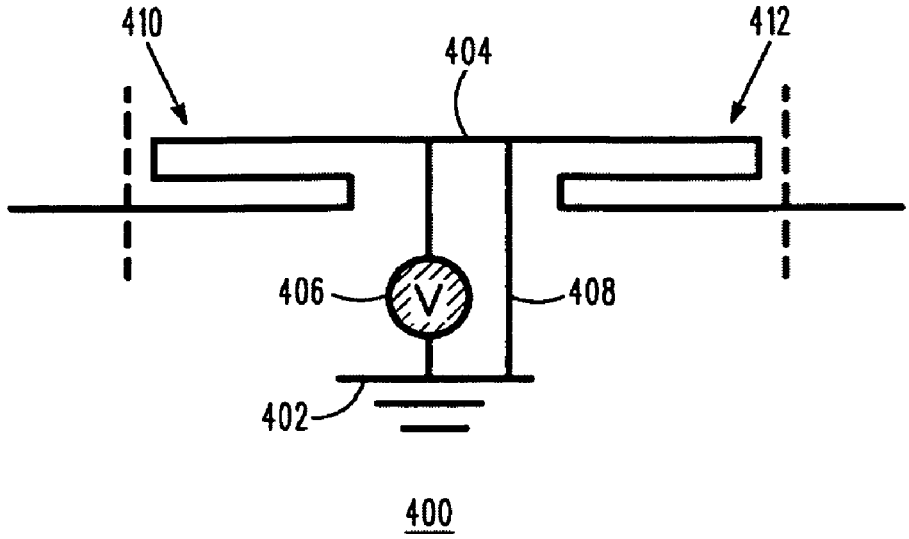
FIG. 4 is a schematic circuit diagram of an antenna useful for operating with reducing field strength suitable for FCC HAC conformance, according to an embodiment of the present invention.

The present invention, according to certain embodiments described herein, operates in modes that reduce the E-field emissions of the wireless handset to a level that easily complies with the FCC HAC maximum limits. To this end, FIG. 4 shows a simplified schematic circuit representation of a first embodiment of the antenna assembly 400 of the present invention. The antenna assembly 400 includes a ground plane 402, such as the ground plane 204 shown in FIG. 2. A ground plane is simply an area of electrically conductive material, e.g., copper, and serves as a near-field reflection point for the antenna structure 400 when operating as described below.

The antenna assembly 400 also includes an element 404, a signal source 406, and a ground leg 408. The function of the element 404 is to "match" the impedance of the air to the signal source 406 that supplies the signals sent or interprets the signals received from the element 404. The element 404, in this particular exemplary embodiment of the present invention, includes two substantially symmetrical arms 410 and 412.

Figure 5:
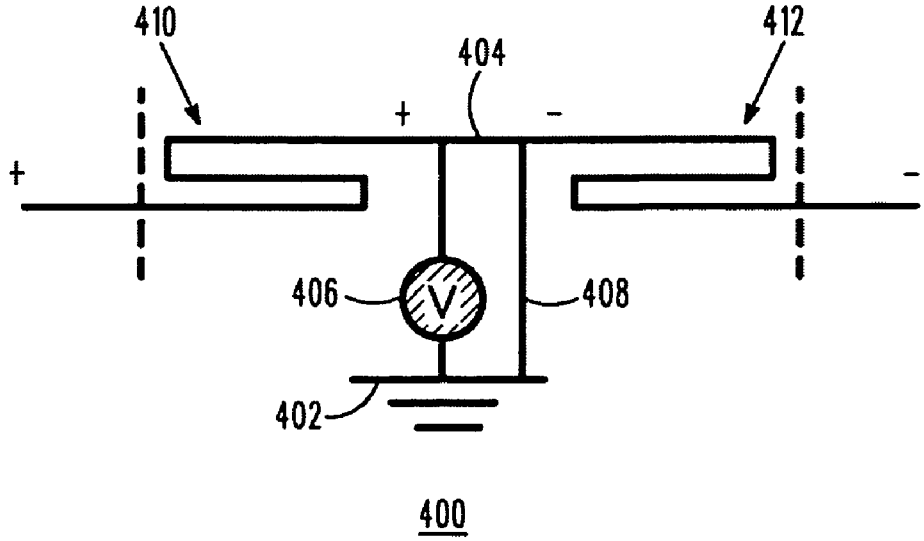
FIG. 5 is a schematic circuit diagram of the antenna of FIG. 4 operating in a differential communication mode, according to an embodiment of the present invention.
Figure 6:
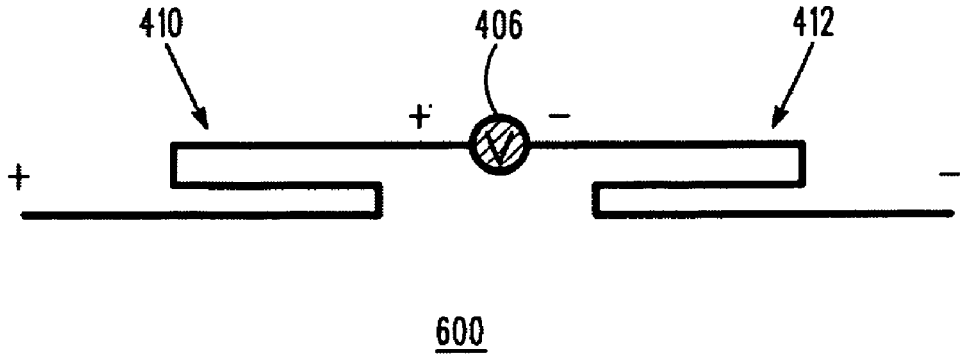
FIG. 6 is a schematic circuit diagram of the differential mode antenna of FIG. 5 driven by an in-line signal source, according to an embodiment of the present invention.

FIG. 5 shows the element 404 being driven by the signal source 406 in a differential mode, indicated by the polarity symbols (+, −). As is shown by the symbols, the left arm 410 of the element 404 is positively charged and the symmetrical right arm 412 of the element 404 is negatively charged. FIG. 6 shows an equivalent circuit 600 where the voltage source 406 is located directly between the two arms 410 and 412. FIG. 6 is classic dipole configuration with the current flowing from the positively charged arm 410 to the negatively charged arm 412 of the conductor 404. In this differential mode, each arm 410 and 412 uses the other as the ground plane and radiates energy. Of course, the view shown in FIGS. 5 and 6 are an instantaneous snapshot of the antenna 400 in operation. In practice, the polarities constantly alternate with the signal source 406 being supplied.

Figure 7:
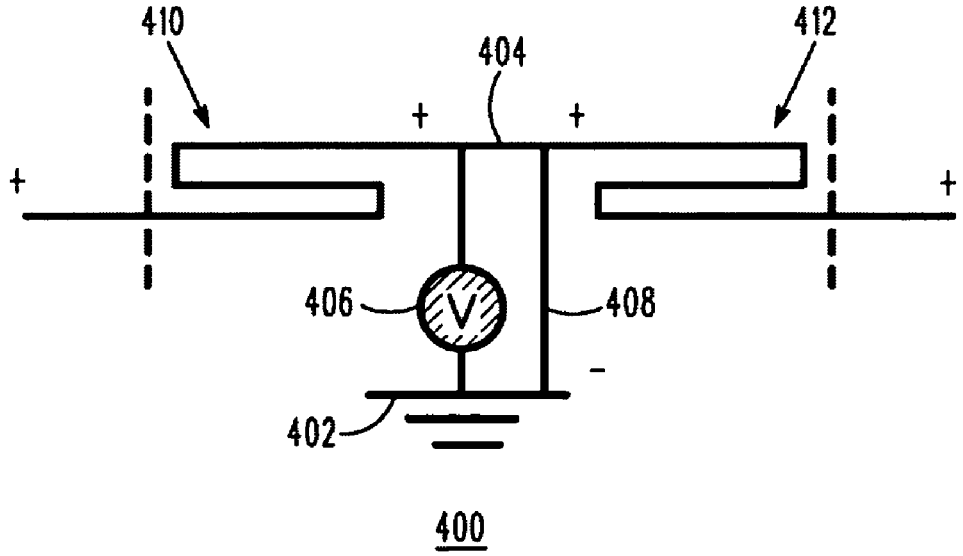
FIG. 7 is a schematic and block circuit diagram of the antenna of FIG. 4 operating in a common communication mode, according to an embodiment of the present invention.

A transmission line can also be driven in a mode that causes it to conduct currents known as "common mode" currents. Common mode current generated on a center-fed element is a situation where the conductor currents in one arm are matched by exactly opposite and equal magnitude currents in the other arm. In this mode, the element 404 behaves like a monopole. FIG. 7 shows the corresponding polarities in this mode. Here, both arms 410 and 412 experience a simultaneous positive polarity and then experience an alternate negative polarity (not shown in this view).

Common mode operation has impedance to ground, to other objects around the element, and to other points in the system. Common mode voltage differences along the line cause current to flow, and the common mode impedance determines current flowing in that mode.

Advantageously, due to the inventive geometry of the element 404 of the present invention and the driving and grounding configuration 402, 406, 408 of the antenna 400, when the element 404 is driven by the signal source 406 at particular frequencies or ranges of frequencies, it transmits and receives in the common mode and, when driven by the signal source 406 at certain other frequencies or ranges of frequencies, transmits and receives in its differential mode. More specifically, when driven at frequencies between 824 MHz and 849

MHz, the antenna 400 operates in the differential mode shown in FIGS. 5 and 6. Alternatively, when driven at frequencies in the low GSM850 and GSM 900 band, the antenna 400 operates in the common mode shown in FIG. 7. Of course, these frequencies are exemplary and the invention is in no way limited to these specific frequencies for its modes. Specific examples of geometries useful for embodiments of the present invention will now be described.

Figure 8:
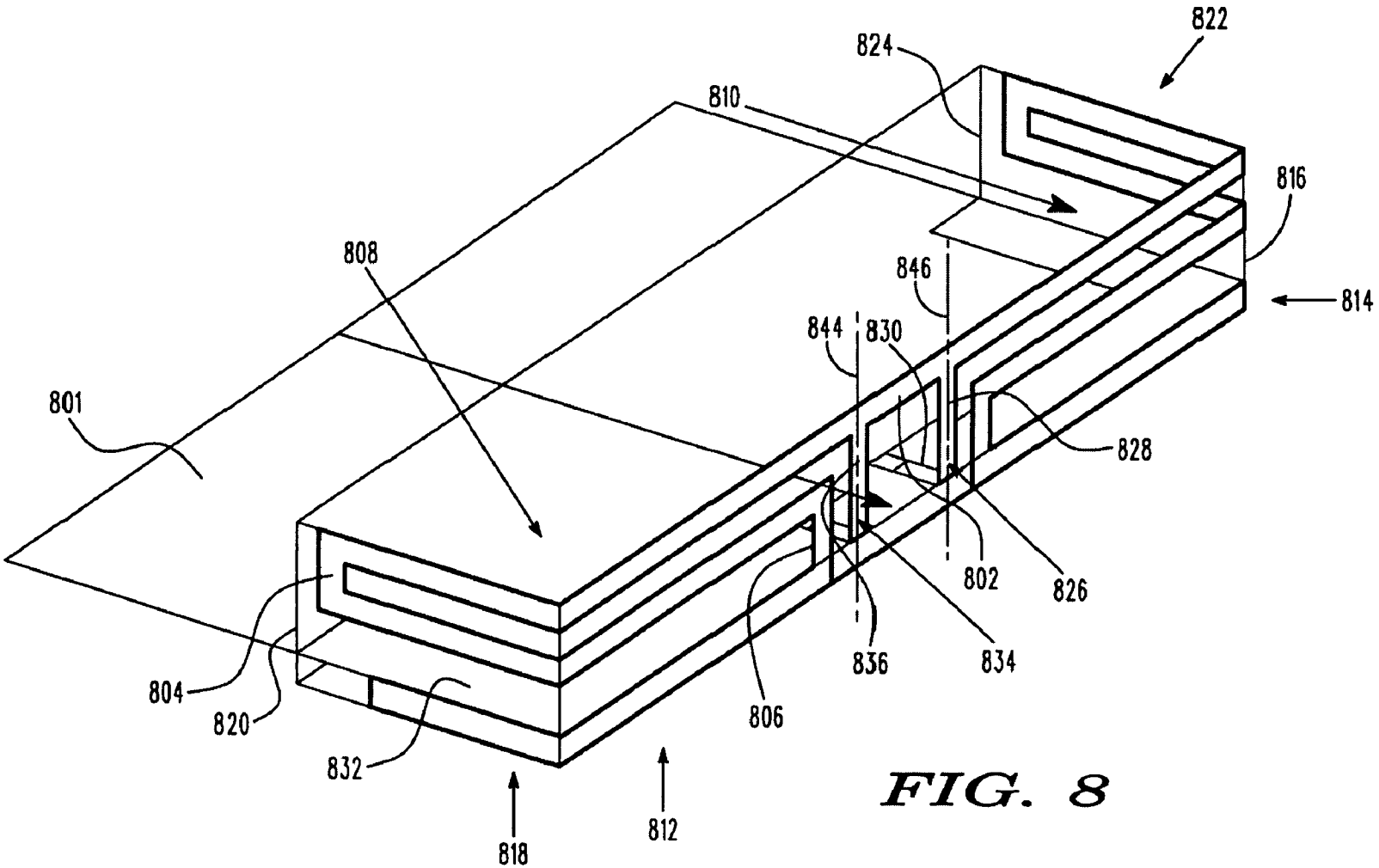
FIG. 8 is a perspective view of a multi-band antenna with an element that is present in three separate planes, according to an embodiment of the present invention.

FIG. 8 shows a perspective view of one exemplary implementation of the present invention that is well suited for placement in a mobile communication device, such as the cellular phone 100 shown in FIG. 1. The embodiment of FIG. 8 includes a ground plane 801 coupled to the element 800. The element 800 has a center point 802 with a first element portion 808 extending away from the center point 802 for a first distance, bending at a first approximately 180 degree bend 804, extending towards the center point 802 for a second distance, bending at a second approximately 180 degree bend 806, and extending away from the center point 802 for a third distance. The term "approximately," as used herein, means near or exact. For instance, "approximately" 180 degrees can mean anywhere in the range of about 160 to 200 degrees. In addition, the second element portion 810 is provided on a side of the center point 802 opposite the first element portion 808 and is substantially a mirror image of the first element portion 808.

The shape of element 800 is considerably similar to the element 404 shown in FIGS. 4-7. In particular, both elements 404 and 800 are meandering elements with symmetrical arms. One notable difference between the element 404 shown in FIGS. 4-7 and the element 800 shown in FIG. 8 is that element 404 is shown in a single plane while element 800 of FIG. 8 is disposed in three separate planes. Specifically, portions 812 and 814 of the first and second element portions 808 and 810, respectively, of element 800, lie within a first plane 816, a portion 818 of the first element portion 808 lies within a second plane 820, and a portion 822 of the second element portion 810 lies within a third plane 824. In each of these planes 816, 820, and 824, the element 800 is planar.

The element 800 has a ground leg 826 located a first distance from the center point 802. The ground leg 826 has a first portion 828 that extends longitudinally in a direction that is substantially perpendicular to a longitudinal direction of the horizontal first 808 and second 810 element portions. The first portion 828, in this particular embodiment, is coupled with a second portion 830. The second portion 830 meets the first portion 828 at an approximately 90 degree angle and runs along the substrate 832 to meet with the ground plane 801. The first 828 and second 830 portions of the ground leg 826 electrically couple the element 800 to the ground plane 801.

A feed leg 834 is located a second distance from the center point 802 and on an opposite side of the center point 802 as the ground leg 826. The feed leg 834 has a first portion 836 and a second portion 838 (shown in FIG. 9) that meets the first portion 836 at an approximately 90 degree angle. A longitudinal axis 844 of the first portion 836 of the feed leg 834 is substantially parallel to a longitudinal axis 846 of the first portion 828 of the ground leg 826.

Figure 9:
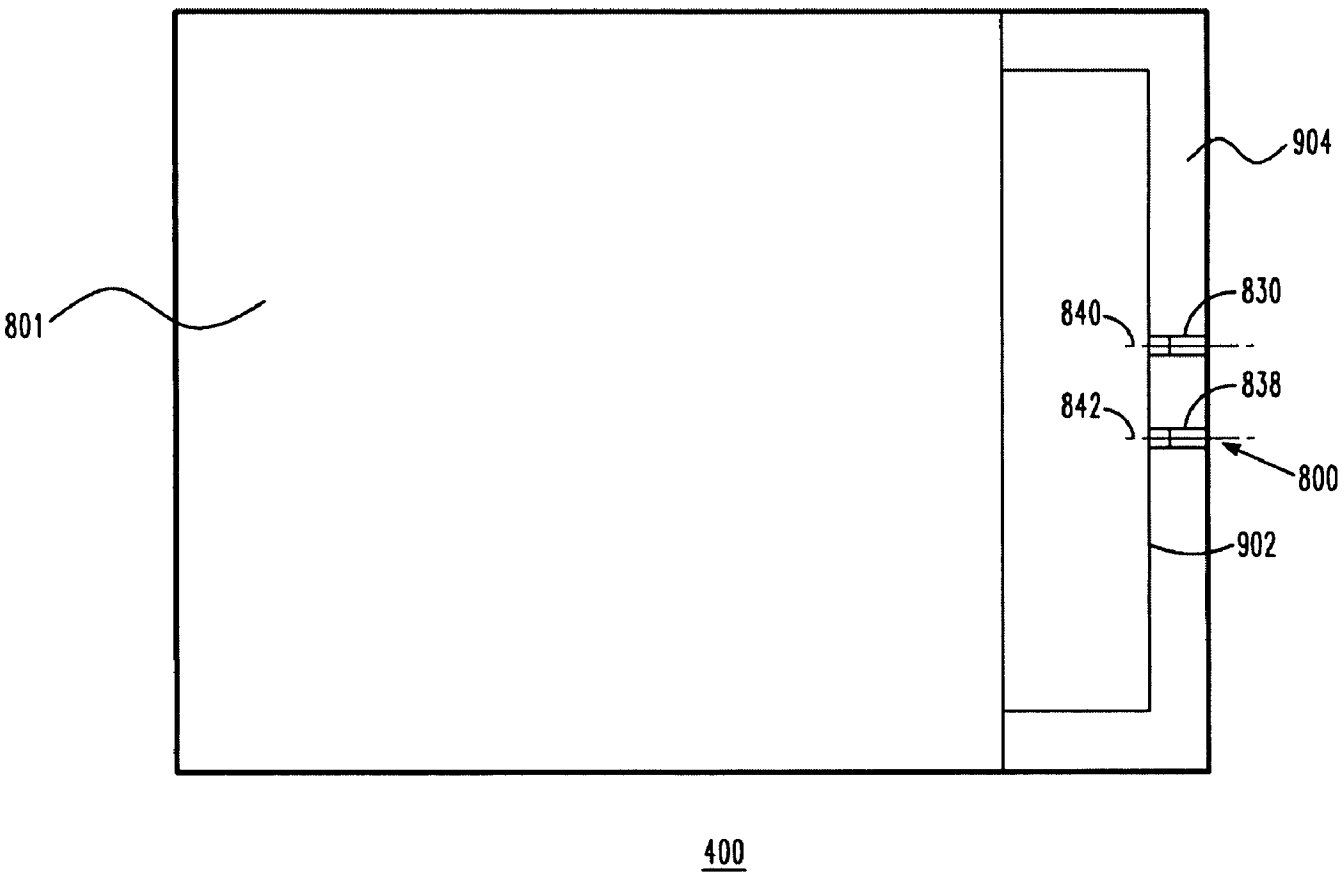
FIG. 9 is a plan view of the multi-band antenna of FIG. 8, according to another embodiment of the present invention.

FIG. 9 shows a plan view of the ground plane 801. From this view, it can be seen that the ground plane 801 has a proximal edge 902 to which the second portion 830 of the ground leg 826 is attached to the ground plane 801. The term "attached," as used herein, means that the antenna and the ground plane are in electrical communication with one another. The attachment can be physical or can be capacitive. The second portion 838 of the feed leg 834 is attached to the transceiver port. The ground plane 801 and element 800 do not necessarily have to be of the same material. For example, the element 800 can be all or partially formed from copper traces etched on a circuit board.

From the view of FIG. 9, it can be seen that a longitudinal axis 842 of the second portion 838 of the feed leg 834 is substantially parallel to a longitudinal axis 840 of the second portion 830 of the ground leg 826. Also shown in FIG. 9 is a keep-out zone 904. The keep-out zone is an area where circuit components and other metallic object are not present or greatly reduced compared to the rest of the board. The distance 904 plays an important role in determining the resonant frequency at which the antenna 400 operates. The lack of interfering components in the keep-out zone reduces the number of parasitics affecting the antenna's performance, i.e., bandwidth and performance.

Additionally, although not shown in FIG. 8, a signal source 406 can be coupled to the fee leg 834. Alternatively, a source can be coupled to the ground leg 826. The signal source 406 can be any signal generating circuit and can be attached, for instance, to a gap in the trace that forms the leg, where the source/driving circuit 406 has corresponding contacts coupled to the portions of the trace forming the gap. Again, this connection is show schematically in FIG. 7.

The element structure 800 is compact in size and is low profile. In one embodiment, the overall dimensions of the element 800 are 45 mm×20 mm×6 mm (transparent blue box). In an embodiment, the ground plane 801 is 100 mm×45 mm, which is a typical mobile phone size.

Figure 10:
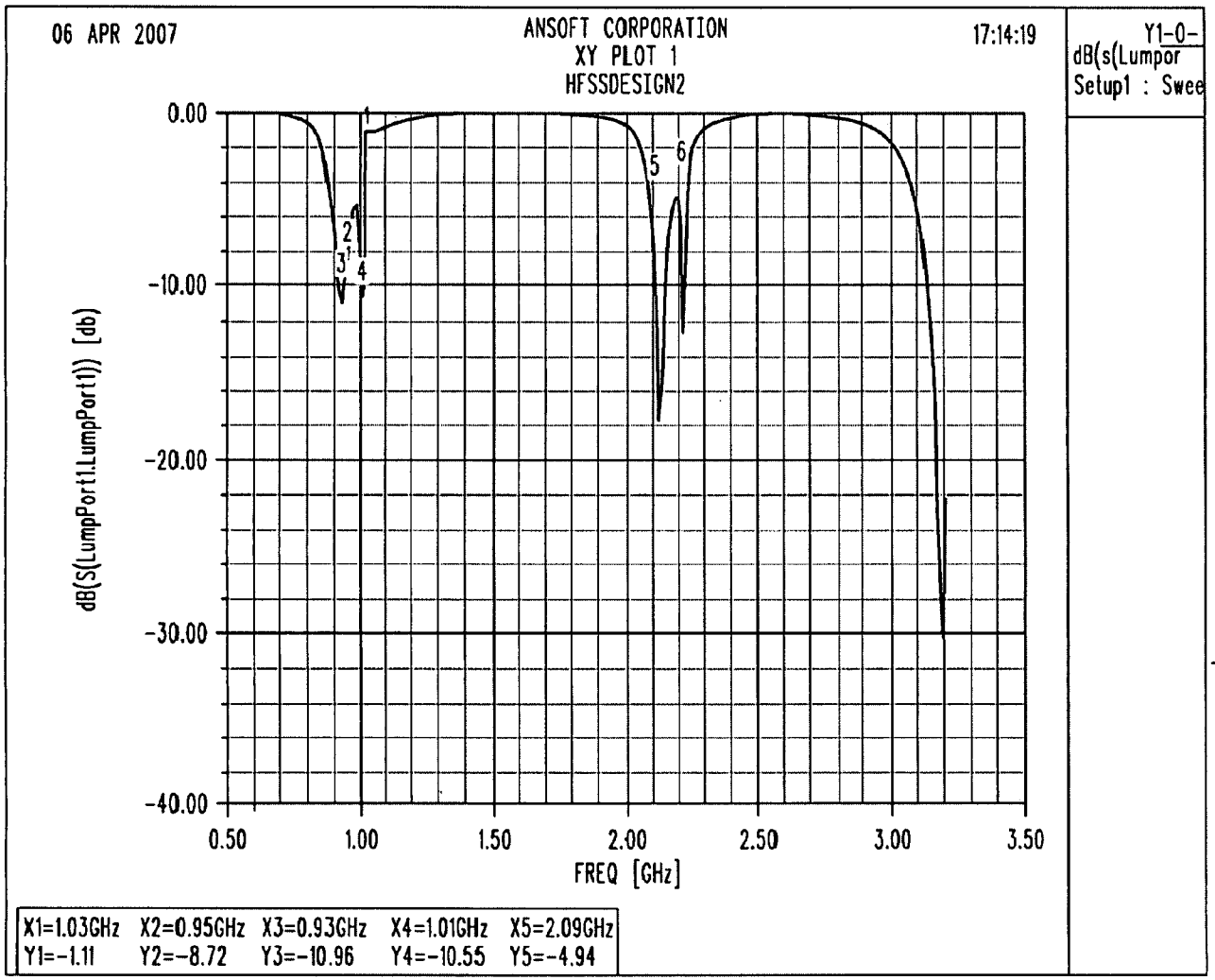
FIG. 10 is an exemplary frequency-response chart for the antenna of FIG. 8, according to an embodiment of the present invention.

When in operation, the antenna 400, which is the topological equivalent to the simplified antenna representation 400 in FIG. 7, has two low frequency modes, and two higher frequency harmonic modes, as shown in the exemplary return loss plot 1000 of FIG. 10.

Figure 11:
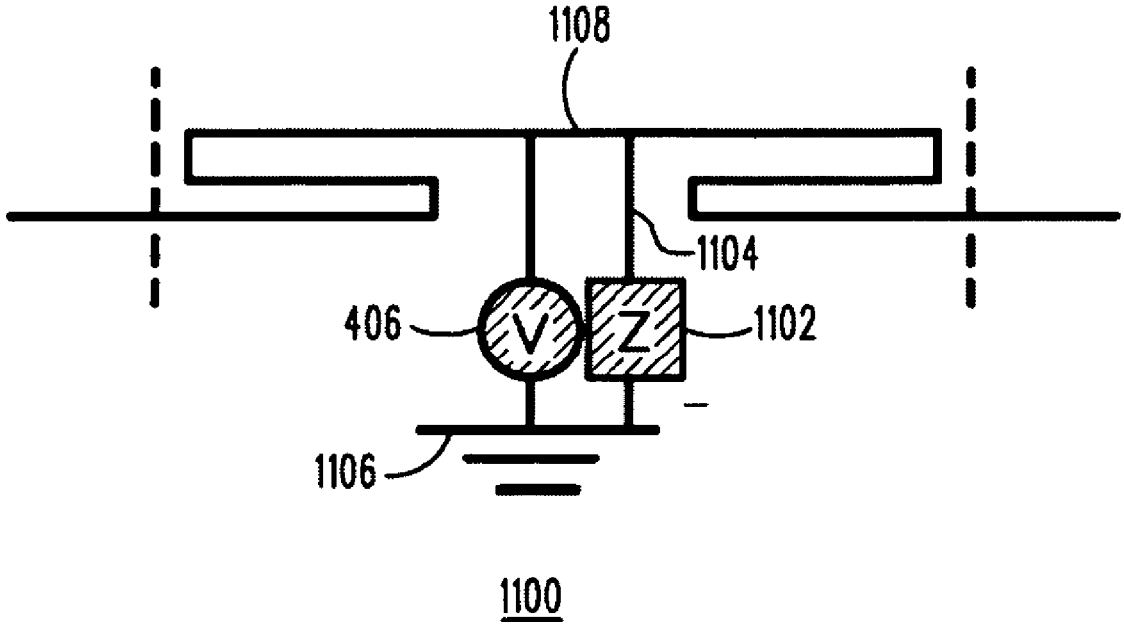
FIG. 11 is a schematic and block circuit diagram of an antenna useful for operating with reducing field strength suitable for FCC HAC conformance and having a reactive component in series with a ground connection, according to an embodiment of the present invention.
Figure 12A:
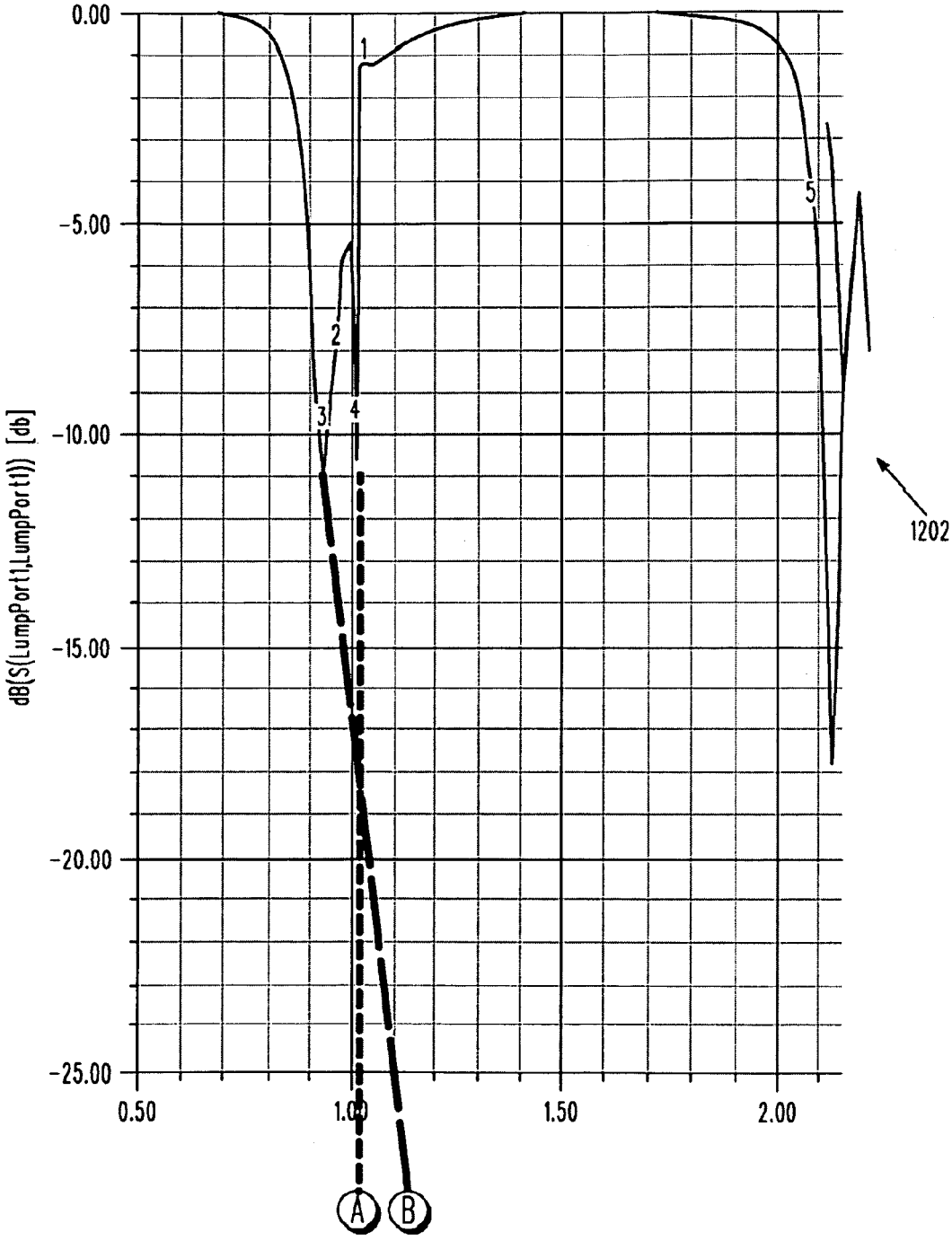
FIGS. 12A and 12B show two exemplary frequency response charts vertically aligned to illustrate mode shifting of the reactive component in the antenna of FIG. 11, according to an embodiment of the present invention.
Figure 12B:
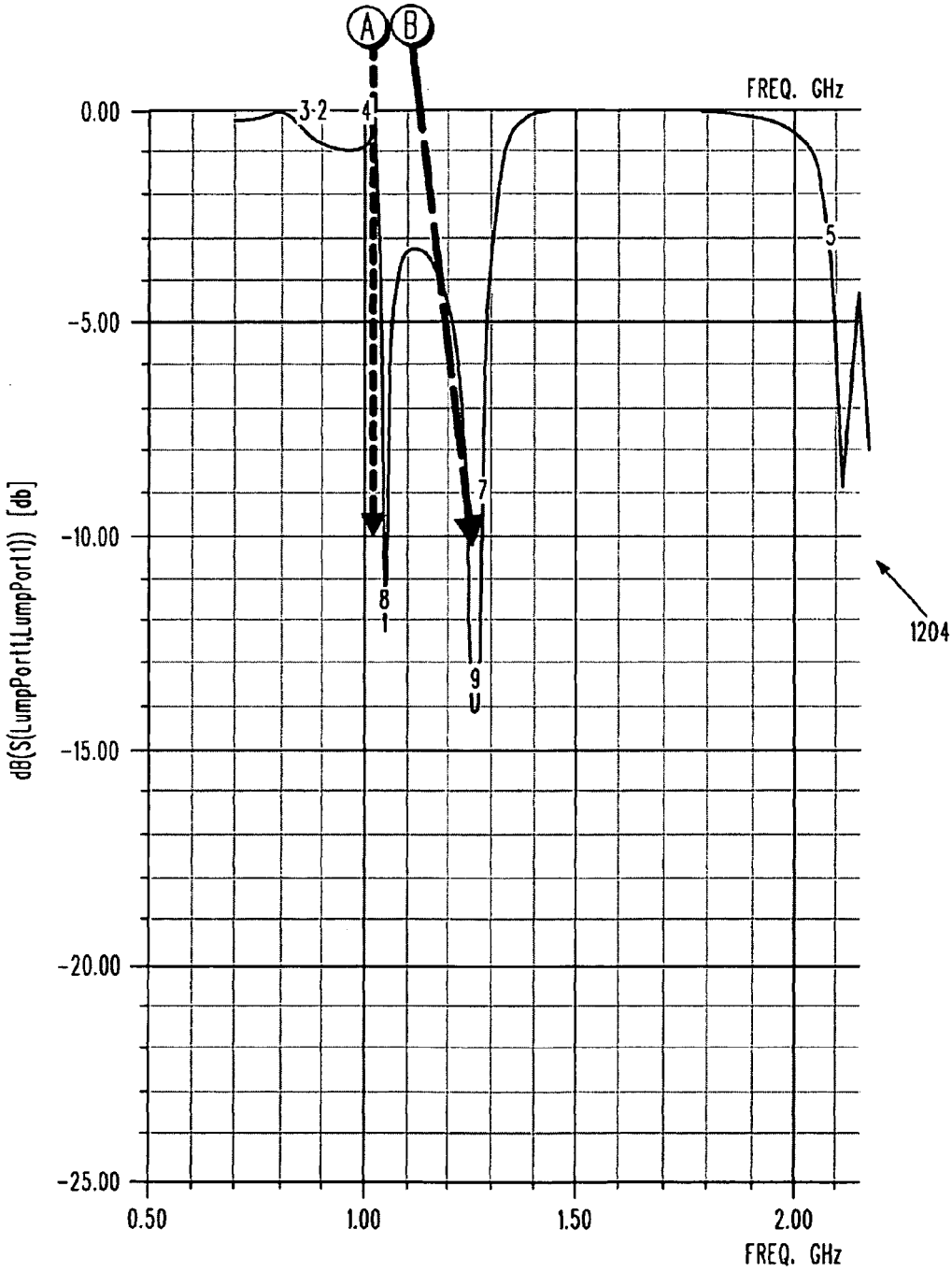

In one embodiment of the present invention, a mode order swap can be achieved by adding a reactive load to the ground leg. This embodiment 1100 is shown in FIG. 11, where a reactive load 1102 is placed in the path 1104 between ground 1106 and the element 1108. When the reactive load 1102 is placed in the path 1104, it substantially affects only the common mode, as the differential mode is self-consistent. This mode swapping is shown in the frequency response graphs 1202 and 1204 in FIG. 12. In the upper graph 1202, representing the antenna 400 (without a reactive component), a common-mode peak 3 occurs at approximately 930 MHz and a differential-mode peak 4 occurs at approximately 1 GHz. A graph 1204, placed directly below graph 1202, shows the frequency response for the antenna 400 with a reactive component 1102 added, as shown in FIG. 1100. In graph 1204, the common mode peak 9 shifted to approximately 1.35 GHz, while the differential mode peak 8 shifted only slightly to 1.05 GHz. The direct comparison of the two graphs 1202 and 1204 shows how the present invention makes it possible to control the order of the two modes in the low band by adding a lumped component (for instance, a 1.5 pF capacitor).

Figure 13:
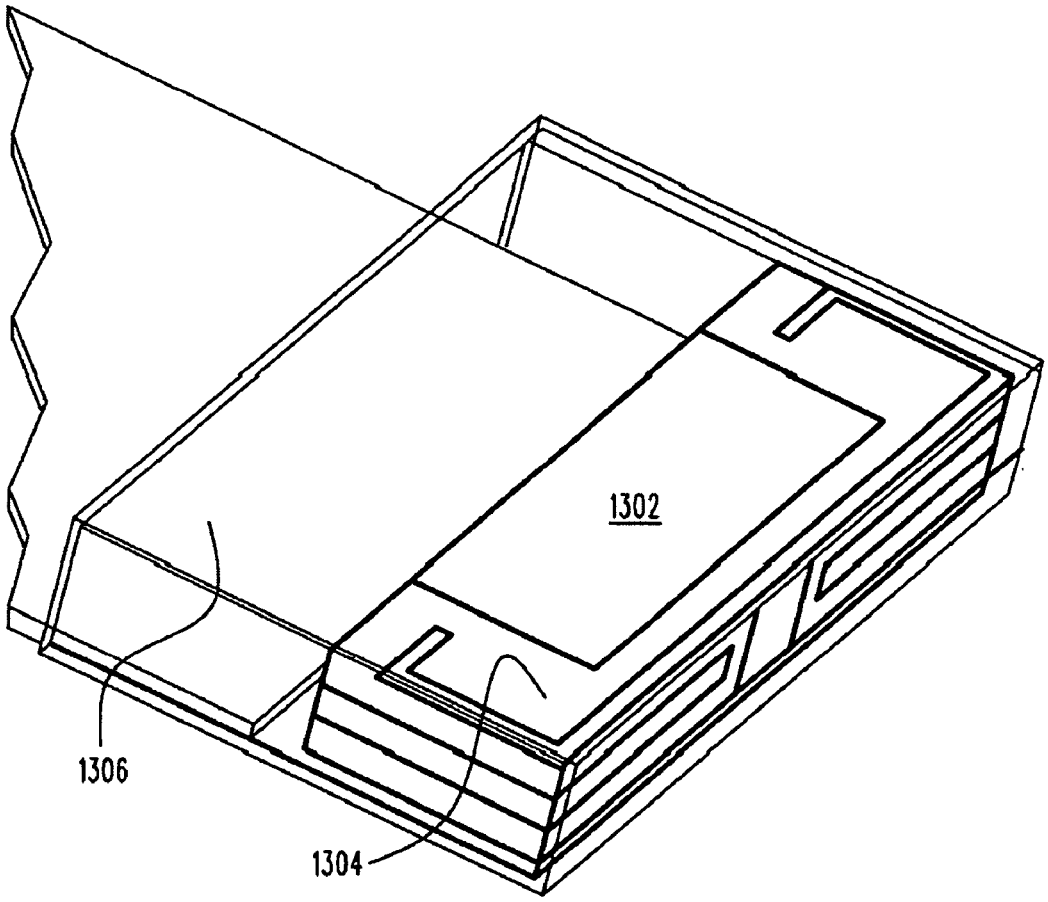
FIG. 13 is a perspective view of a multi-band antenna with an element that is present in three separate planes and supported by a plastic shell, according to an embodiment of the present invention.

FIG. 13 shows an embodiment 1300 adapted for use in a mobile phone. The structure 1300 includes a plastic support 1302, the antenna element 1304, and a plastic shell 1306. It is noted that the antenna element 1304, although a similar meandering element to that shown in the previous figures, has a slightly different geometric shape. This embodiment shows that variations of the particular geometric embodiments illustrated in the figures of the instant specification are for illustrative purposes only and the invention is in no way limited to the specific structures shown.

Figure 14:
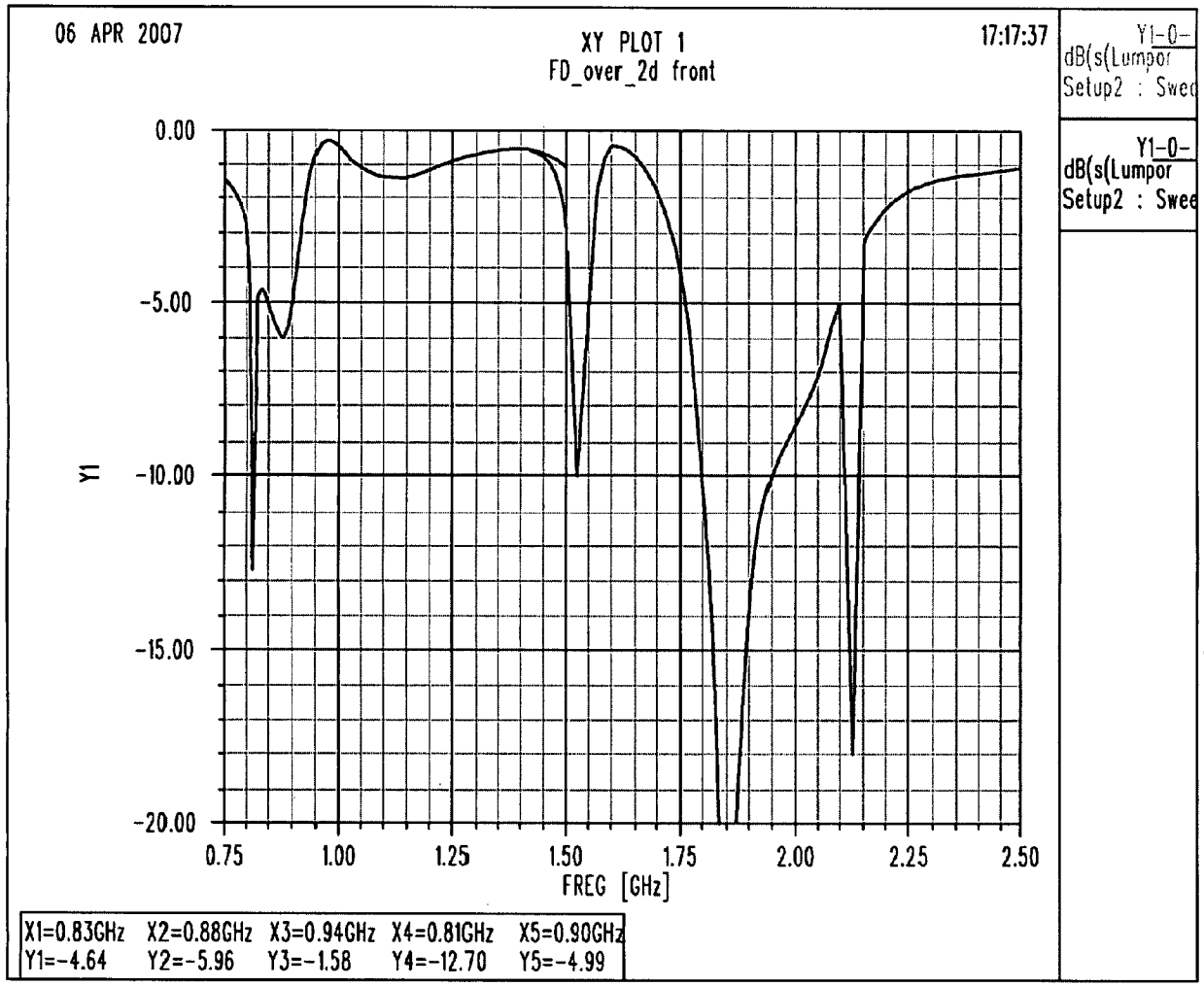
FIG. 14 is an exemplary frequency-response chart for the antenna of FIG. 13, according to an embodiment of the present invention.

FIG. 14 is a return loss graph with two modes in the low band, the lowest mode being the differential mode (2 pF capacitor added on the ground leg). The antenna shows additional modes in the high band (1.25 GHz and up); in this case the bandwidth achieved is sufficient for covering DCS, PCS and WCDMA 2100. The additional differential mode in the high band is at a higher frequency w/respect to the high common mode.

Figures 15, 16, 17, 18, 19, 20, 21:
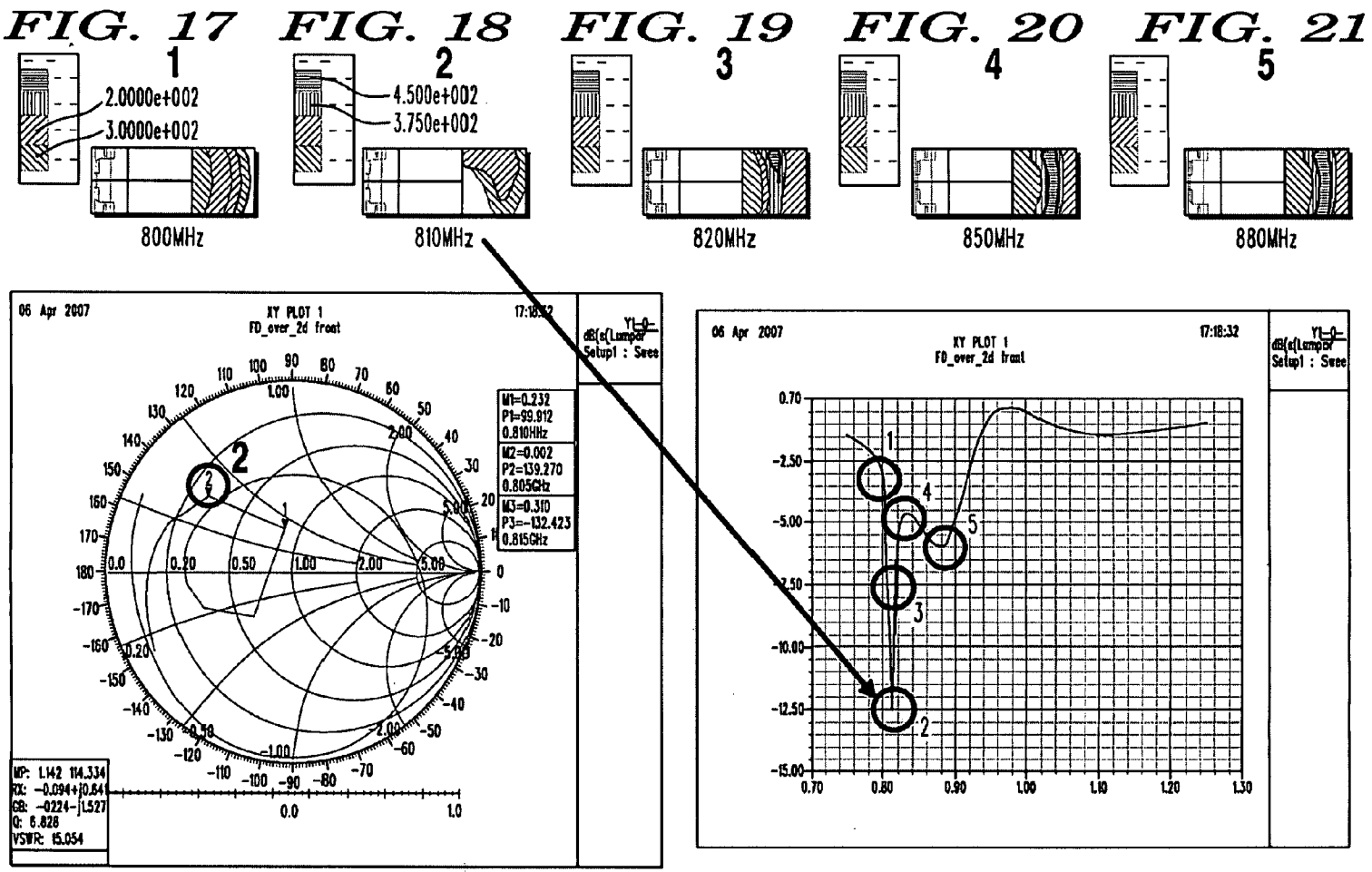
FIGS. 15 to 21 illustrate an exemplar, frequency-response chart showing a reduction of low-band E-Field radiation for hearing aid compatibility purposes, achieved by embodiments of the present invention.

FIGS. 15 to 21 illustrate the low band E-Field reduction for hearing aid compatibility purposes achieved by embodiments of the present invention. FIGS. 15 and 16 show screen prints from a network analyzer, which shows a Smith chart representation and a return-loss graph of a frequency band from 700 to 1.3 GHz and, in particular, the frequencies 800, 810, 820, 850, and 880 MHz. Advantageously, the E-field value depicted in FIGS. 17 to 21 (in correspondence to the position where the HAC scan is performed) is reduced by 3 dB at 810 MHz (differential mode, 2).

FIGS. 22 to 26 show two E-Field snapshots of the low-band resonances, where the two modes, common and differential, are shown. The side-by-side comparison of the snapshots clearly show the E-field is more constrained in the antenna area for the differential mode (A), whereas it is more spread above the PCB surface 1602 for the common mode (B).

CONCLUSION

The inventive antenna structure, which has just been described, provides a meandering multi-band planar inverted antenna with two almost symmetric arms, a feed post, and a ground post, where the antenna structure is capable of different operating modes, including at least two differential modes, one for the low band and one for the high band. A reactive load is used on the ground post to selectively vary the resonant frequency of the common modes, while leaving the differential mode frequencies unchanged. The antenna addresses the need for Hearing Aid Compatibility compliance for mobile devices and in particular phones for the GSM850 band without adding extra complexity and/or additional parts.

NON-LIMITING EXAMPLES

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically. The term "about" or "approximately," as used herein, applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

What is claimed is:

1. An antenna assembly comprising:

a ground plane; and an element coupled to the ground plane, the element including:

a center point;

a first element portion extending away from the center point on a first side of the center point for a first distance in a first direction, bending at a first approximately 180 degree bend, extending towards the center point for a second distance in a second direction, bending at a second approximately 180 degree bend, and extending away from the center point for a third distance in the first direction;

a second element portion provided on a second side of the center point opposite the first element portion on the first side of the center point, the second element portion being substantially a mirror image of the first element portion;

a ground leg located on the first side of the center point a first distance from the center point, extending substantially perpendicular to the first and second element portions, and coupling the element to the ground plane; and a feed leg located on the second side of the center point a second distance from the center point, the feed leg extending substantially parallel to the ground leg.

2. The antenna assembly according to claim 1, wherein:

parts of the first and second element portions lie within a first plane;

a part of the first element portion lies within a second plane that is different from the first plane; and a part of the second element portion lies within a third plane that is different from the first and second planes.

3. The antenna assembly according to claim 2, wherein:

the second and third planes are approximately perpendicular to the first plane.

4. The antenna assembly according to claim 2, wherein:

the second and third planes are approximately parallel with each other.

5. The antenna assembly according to claim 3, wherein:

the second and third planes are approximately parallel with each other.

6. The antenna assembly according to claim 2, wherein:

a part of the first element portion immediately adjacent the first approximately 180 degree bend and a part of the mirror-image second element portion immediately adjacent a corresponding approximately 180 degree bend of the second element portion are in the second plane.

7. The antenna assembly according to claim 2, wherein:

the ground plane is approximately perpendicular to each of the first, second, and third planes.

8. The antenna assembly according to claim 1, further comprising:

a signal source coupled to the feed leg between the element and the ground plane.

9. The antenna assembly according to claim 8, wherein:

the signal source is operable to output at least a first frequency range and a second frequency range, where all frequencies within the second frequency range are higher than frequencies within the first frequency range.

10. The antenna assembly according to claim 8, wherein:

the antenna automatically operates in a differential mode at the first frequency range and automatically operates in a common mode at the second frequency range.

11. The antenna assembly according to claim 1, further comprising:

a reactive load provided between a first point and a second point within the ground leg.

12. A wireless communication device comprising:

a signal source operable to output at least a first frequency range and a second frequency range, where all frequencies within the second frequency range are higher than frequencies within the first frequency range;

a ground plane; and an antenna coupled to the ground plane and the signal source, the antenna having a center point and including:

a first double folded element arm having:

a first portion extending away from the center point of the antenna on a first side of the center point in a first direction substantially parallel with the ground plane; and a second portion extending towards the center point of the antenna in a second direction substantially parallel with the ground plane; and a second double folded element arm on a second side of the center point and substantially symmetrical to the first double folded element arm with respect to the center point, the antenna automatically operating in a differential mode at the first frequency range and automatically operating in a common mode at the second frequency range.

13. The communication device according to claim 12, further comprising:

a reactive load disposed between the second element arm and the ground plane, the reactive load causing the antenna to automatically operate in the common mode at a third frequency range that is higher than the second frequency range.

14. The communication device according to claim 12, wherein:

the first and second folded element arms each extend away from the center point of the antenna for a first distance, fold at a first approximately 180 degree bend, extend toward the center point for a second distance, fold at a second approximately 180 degree bend, and extend away from the center point for a third distance.

15. The antenna according to claim 12, wherein:

first-plane portions of the first and second element arms lie within a first plane;

a second-plane portion of the first element arm lies within a second plane that is different from the first plane; and a third-plane portion of the second element arm portion lies within a third plane that is different from the first and second planes.

16. The antenna according to claim 15, wherein:

the second and third planes are approximately perpendicular to the first plane.

17. The antenna according to claim 15, wherein:

the second and third planes are approximately parallel with each other.

18. The antenna according to claim 14, wherein:

a portion of the first element arm immediately adjacent the first approximately 180 degree bend and a portion of the second element arm immediately adjacent the first approximately 180 degree bend are in the second plane.

19. The antenna according to claim 15, wherein:

the ground plane is approximately perpendicular to each of the first, second, and third planes.

20. The antenna according to claim 12, further comprising:

a ground leg disposed on the first side of and a first distance from the center point, extending approximately perpendicular to the first and second element portions, and coupling the antenna to the ground plane; and a feed leg disposed at on a second side of and a second distance from the center point different from the first distance and on an opposite side of the center point with respect to the ground leg, the feed leg being substantially parallel to the ground leg.

* * * * *